US007437898B2

(12) United States Patent
Su

(10) Patent No.: US 7,437,898 B2
(45) Date of Patent: Oct. 21, 2008

(54) LOCK DEVICE

(76) Inventor: Wen-chun Su, No. 5, Alley 3, Lane 88, Wu Chyuan Rd., Shen Kang, Hsiang, Taichung Hsien (TW)

( * ) Notice: Subject to any disclaimer, the term of this patent is extended or adjusted under 35 U.S.C. 154(b) by 0 days.

(21) Appl. No.: 11/934,006

(22) Filed: Nov. 1, 2007

(65) Prior Publication Data

US 2008/0115548 A1 May 22, 2008

(30) Foreign Application Priority Data

Nov. 17, 2006 (TW) ..... 95220332 U

(51) Int. Cl.
*E05B 73/00* (2006.01)
*E05B 17/14* (2006.01)

(52) U.S. Cl. ..... 70/14; 70/18; 70/56; 70/423; 70/455

(58) Field of Classification Search ..... 70/14, 70/18, 30, 43, 49–56, 58, 417, 423–428, 70/455, DIG. 43, DIG. 56
See application file for complete search history.

(56) References Cited

U.S. PATENT DOCUMENTS

| | | | | | |
|---|---|---|---|---|---|
| 1,460,518 | A * | 7/1923 | Szydlowski | 70/30 |
| 1,718,723 | A * | 6/1929 | Williams | 70/38 A |
| 2,834,195 | A * | 5/1958 | Stackhouse | 70/339 |
| 4,372,138 | A * | 2/1983 | De Forrest | 70/56 |
| 4,464,915 | A * | 8/1984 | Moshe et al. | 70/52 |
| 4,790,163 | A * | 12/1988 | Appelbaum | 70/455 |
| 5,475,993 | A * | 12/1995 | Kuo | 70/18 |
| 5,535,609 | A * | 7/1996 | Kuo | 70/423 |
| 5,761,934 | A * | 6/1998 | Kuo | 70/49 |
| 5,832,762 | A * | 11/1998 | McDaid | 70/455 |
| 6,408,661 | B1 * | 6/2002 | Chen | 70/33 |
| 6,481,250 | B1 * | 11/2002 | Kuo | 70/49 |
| 6,782,723 | B2 * | 8/2004 | Chen | 70/49 |

* cited by examiner

*Primary Examiner*—Lloyd A Gall
(74) *Attorney, Agent, or Firm*—WPAT, P.C.; Anthony King

(57) ABSTRACT

A lock device includes a lock head, a lock case, a cap, and a lock shaft unit. The lock head is inserted into the lock case. The lock case is provided with an anti-dust cover which is rotatable with respect to the cap. The lock shaft unit is pivotally connected to the lock case, allowing the lock shaft unit to rotate in 360 degrees with respect to the lock case.

8 Claims, 9 Drawing Sheets

LOCK DEVICE

BACKGROUND OF THE INVENTION

1. Field of the Invention

The present invention relates to a lock device, and more particularly to one that comprises a lock head, a lock case provided with a cap and an anti-dust cover which are rotatable with each other, and a lock shaft unit pivoted to the lock case so as to rotate in 360 degrees with each other.

2. Description of the Prior Art

A conventional lock device comprises a lock shaft unit and a lock head. The lock shaft unit comprises an engaging rod with an engaging block at one end and a connecting rod at the other end. The lock head comprises a lock core, an engaging hole and a connecting hole thereon for connection of the engaging rod and the connecting rod respectively.

However, when the engaging block is inserted into the engaging hole, the engaging block will be supported only by the engaging hole, which is not strong enough to hold the engaging rod, thus the rod is shaking and in a unstable condition with the lock head. Furthermore, the lock shaft unit and the lock head can not rotate 360 degrees with each other, which causes the operation difficult.

SUMMARY OF THE INVENTION

This invention provides a lock device to solve the problems of operation, anti-dust and stability.

According to a first aspect of the present invention, there is provided a lock device comprising a lock head, a lock case, a cap and a lock shaft unit, said lock head being disposed in said lock case, said lock case comprising an anti-dust cover which is connected to and rotatable with respect to said cap, said lock shaft unit being pivotally connected to said lock case in a 360 degrees rotation manner.

According to a second aspect of the present invention, there is provided a lock device, comprising:

a lock head, said lock head having a first insertion hole and a first trough;

a lock case fitting on said lock head, said lock case comprising a second insertion hole, a second trough and a third trough, said second insertion hole corresponding to said first insertion hole for insertion of a lock core, said second trough corresponding to said first trough, said third trough being opposite to said second trough, said lock case further comprising an anti-dust cover having a third insertion hole;

a cap disposed on said lock case in a rotable manner with respect to said lock case, said anti-dust cover being rotatable with respect to said cap, said cap having a fourth insertion hole and a fourth trough, said fourth insertion hole corresponding to said first insertion hole and said second insertion hole, said fourth trough corresponding to said first trough and said second trough;

a lock shaft unit pivoted to said lock case, said lock shaft unit comprising a connecting rod, a linking rod, and an insertion rod, both said connecting rod and said linking rod having a pair of pivot holes at respective ends thereof, said insertion rod having an insertion end and a connecting end, said insertion end being in a conical shape with a through hole thereat, said connecting end having a pivot hole for insertion of a pin, said connecting rod being pivoted to said lock case, said insertion end corresponding to and inserting into said fourth trough, said first trough, said second trough and said third trough.

Preferably, said lock head is provided with a bolt at the top of said lock head to secure said connecting rod of said lock shaft unit with said lock case and said anti-dust cover, allowing said connecting rod to rotate in 360 degrees with respect to said lock case and said anti-dust cover.

Preferably, said bolt has a cap at one end, a threaded section, and a flat section at the other end opposing said cap, said flat section being punched to form another cap after assembled.

According to a third aspect of the present invention, there is provided a lock device, comprising:

a lock head, said lock head comprising a first through hole, a first insertion hole, a first securing hole, a first trough, a groove and a tray, a hole and a slot being formed in said groove for insertion of a linking shaft, a sliding plate and a latch, said linking shaft corresponding to said hole and having an insertion hole and a protuberance, said sliding plate having a linking slot and a connecting trough, said linking slot being adapted to receive said protuberance, said latch having a circular trough to engage with said connecting trough, said latch corresponding to said first trough, a plate being provided in said tray, said first through hole being provided with a bolt;

a lock case fitting on said lock head, said lock case having a second through hole, a second insertion hole, a second securing hole, a second trough, and a third trough, said second through hole corresponding to said first through hole, said second insertion hole corresponding to said first insertion hole, said second securing hole corresponding to said first securing hole, said second trough corresponding to said first trough, said second trough being in parallel with said third trough, said lock case further comprising an anti-dust cover having a through hole and a third insertion hole, a nut being provided in said through hole;

said cap disposed on said lock case, said cap having a fourth insertion hole and a fourth trough, said fourth insertion hole corresponding to said first insertion hole and said second insertion hole, said fourth trough corresponding to said first trough and said second trough; and a lock shaft unit, said locking shaft unit comprising a connecting rod, a linking rod, and an insertion rod, both said connecting rod and said linking rod having a pair of pivot holes at respective ends thereof, said insertion rod comprising an insertion end and a connecting end, said insertion end being in a conical shape with a through hole thereat, said connecting end having a pivot hole, a pin being inserted into said abutted two pivot holes, said connecting rod being connected to said lock case and said anti-dust cover through said bolt of said lock head, and secured to said lock case with said nut.

Preferably, said bolt has a cap at one end, a threaded section, and a flat section at the other end opposing said cap, said flat section being punched to form another cap after screwed to said nut, allowing said lock shaft unit to rotate with respect to said lock case and said anti-dust cover in 360 degrees.

Preferably, said bolt is inserted through said first through hole, said second through hole, and said through hole of said anti-dust cover, and then secured with said nut with a portion extending into said pivot hole of said connecting rod.

It is the primary object of the present invention to provide a lock device, which is able to rotate in 360 degrees for operation convenience.

It is another object of the present invention to provide a lock device, which comprises an anti-dust cover and a cap to protect the lock device from dust.

It is a further object of the present invention to provide a lock device, which provides a lock shaft unit having a flat body and is easy to store and to carry.

It is still a further object of the present invention to provide a lock device, which uses a second trough and a third trough to support the lock shaft unit to prevent the lock device from looseness in a locked position.

DETAILED DESCRIPTION OF THE PREFERRED EMBODIMENTS

Figure 1:
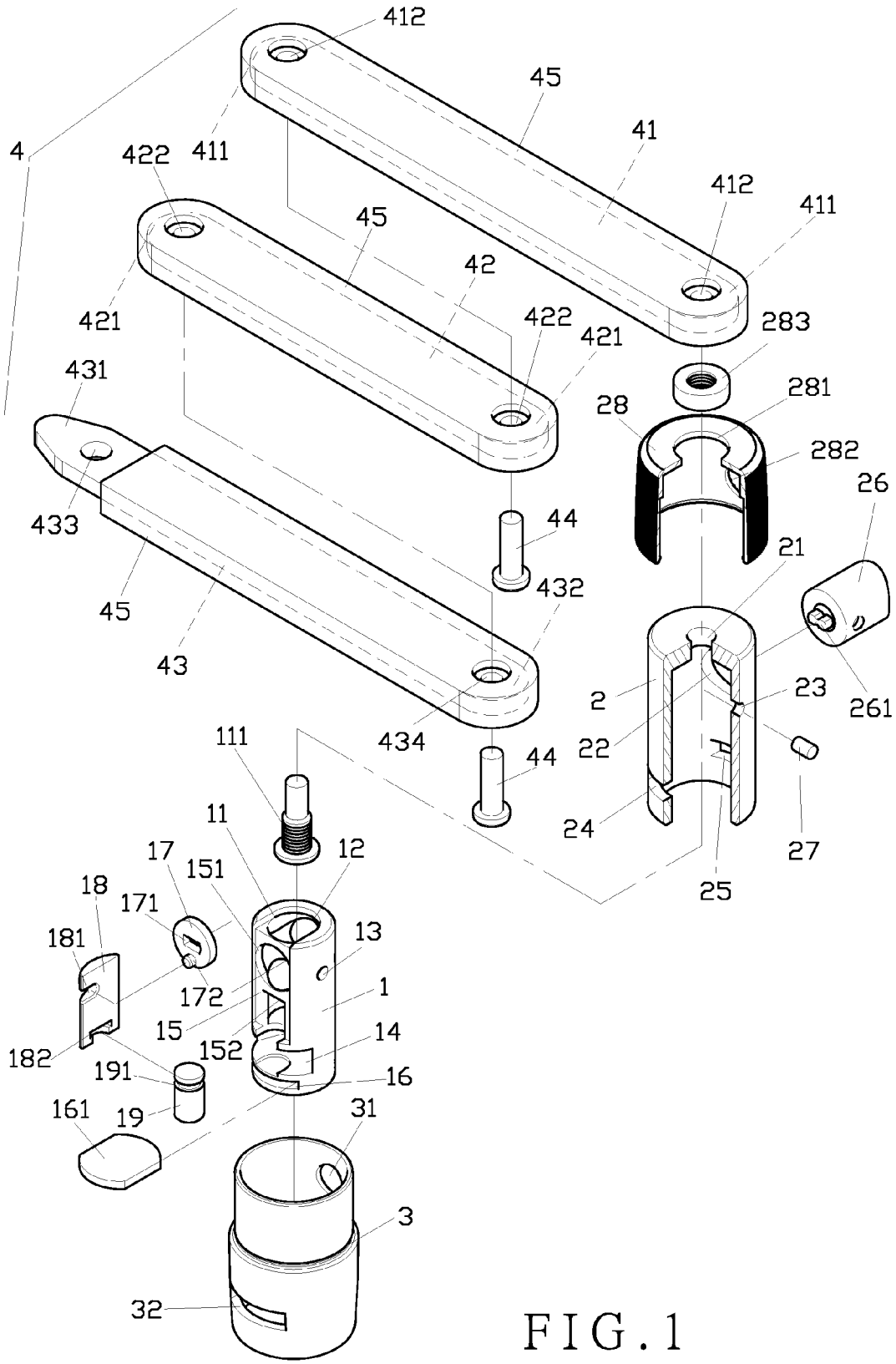
FIG. 1 is an exploded view of the present invention, partially sectioned.

As shown in FIG. 1, a preferred embodiment of the present invention comprises a lock head 1, a lock case 2, a cap 3 and a lock shaft unit 4.

Figure 2:
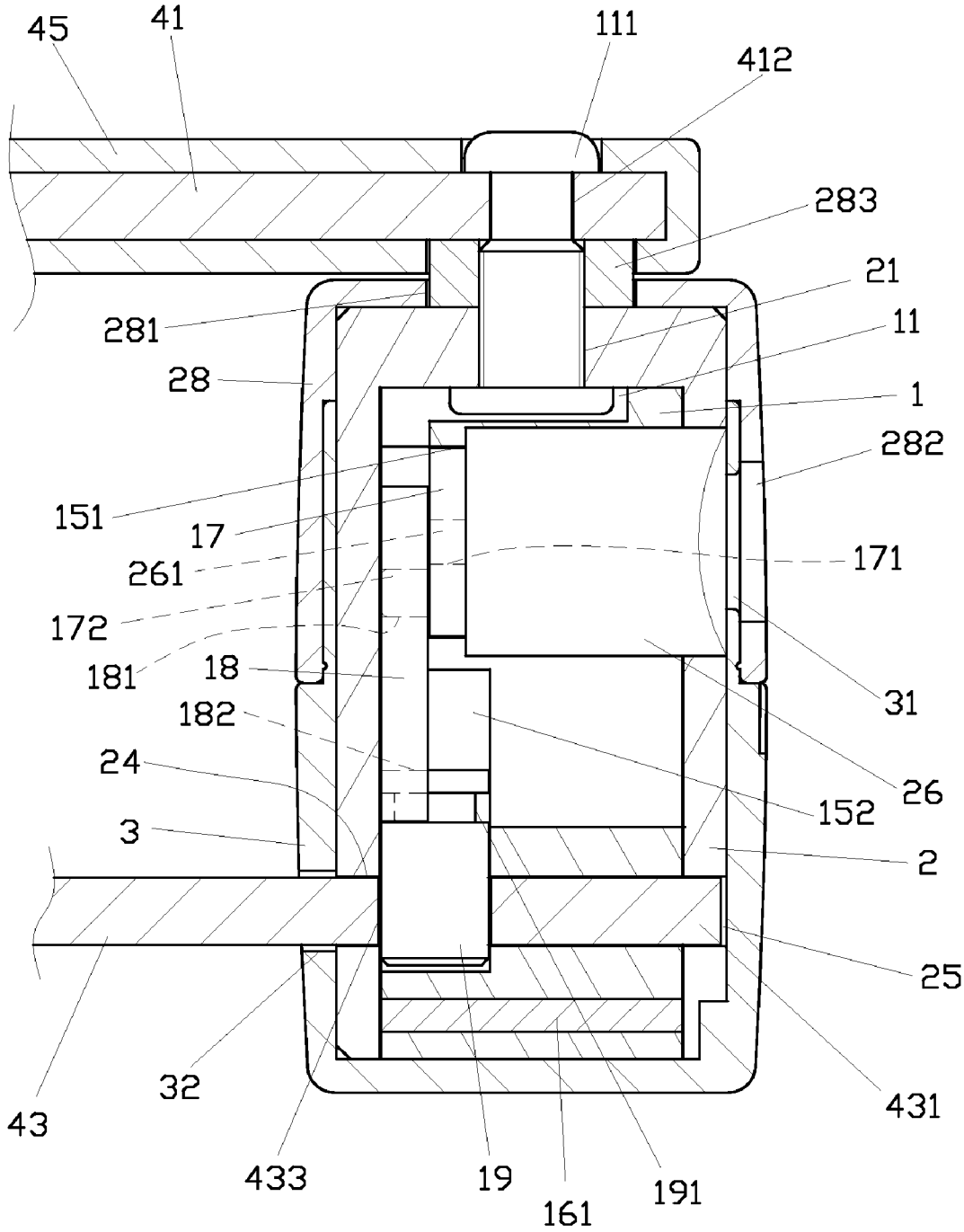
FIG. 2 is a cross-sectional view of the present invention, longitudinally sectioned.
Figure 3:
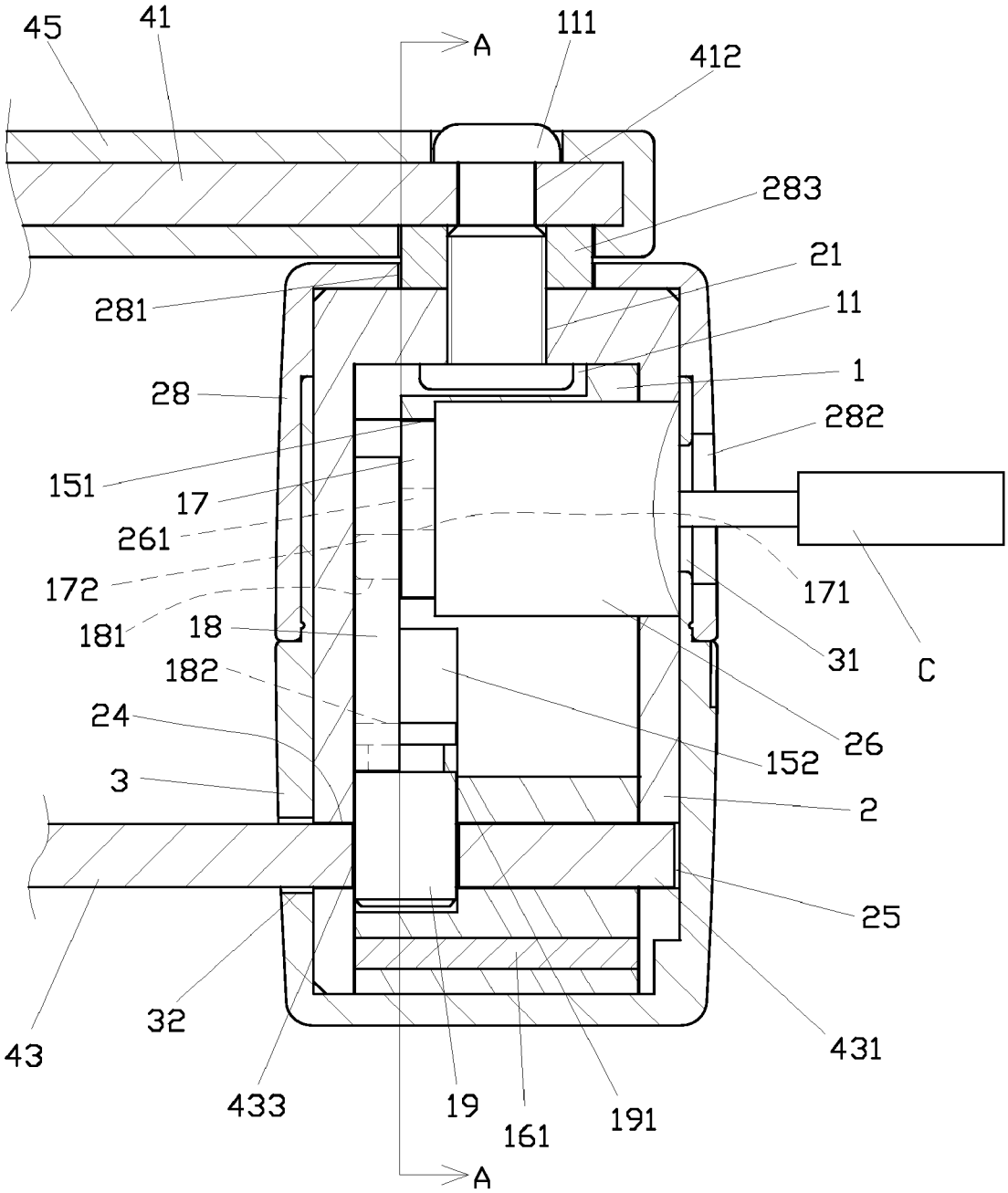
FIG. 3 is a cross-sectional view of the present invention showing a latch engaging with a lock shaft unit.

The lock head 1 comprises a first through hole 11 at the top thereof, a first insertion hole 12, a first securing hole 13, a first trough 14, a groove 15, and a first tray 16 on the circumference of the lock head 1. A hole 151 and a slot 152 are formed in the groove 15 for insertion of a linking shaft 17, a sliding plate 18 and a latch 19. The linking shaft 17 comprises an insertion hole 171 and a protuberance 172. The sliding plate 18 has a linking slot 181 and a connecting trough 182. The linking slot 181 of the sliding plate 18 is adapted to receive the protuberance 172 of the linking shaft 17 therein. The latch 19 has a circular trough 191 adapted to connect with the connecting trough 182 of the sliding plate 18. The latch 19 is disposed in the first trough 14. The first tray 16 is to receive a plate 161 therein. The first through hole 11 is inserted with a bolt 111 which has a cap at one end, a threaded section, and a flat section at the other end opposite the cap. The flat section of the bolt 111 will be punched to form another cap after assembled, as shown in FIGS. 2 and 3.

The lock case 2 is inserted onto the lock head 1 and comprises a second through hole 21 at the top thereof, a second insertion hole 22, a second securing hole 23, a second trough 24, and a third trough 25 on the circumference of the lock case 2. The second through hole 21 corresponds to the first through hole 11. The second insertion hole 22 corresponds to the first insertion hole 12 for insertion of a lock core 26. The second securing hole 23 corresponds to the first securing hole 13 for insertion of a pin 27. The second trough 24 corresponds to the first trough 14. The second trough 24 is opposite to the third trough 25. The anti-dust cover 28 is located on the lock case 2 and comprises a through hole 281, a third insertion hole 282 and a nut 283 thereon.

The cap 3 sleeved on the lock case 2 comprises a fourth insertion hole 31 and a fourth trough 32. The fourth insertion hole 31 corresponds to the first insertion hole 12 and the second insertion hole 22. The fourth trough 32 corresponds to the first trough 14 and the second trough 24. The anti-dust cover 28 is coupled to the cap 3 with the third insertion hole 282 corresponding to the fourth insertion hole 31. The anti-dust cover 28 is able to rotate with respect to the cap 3.

Figure 8:
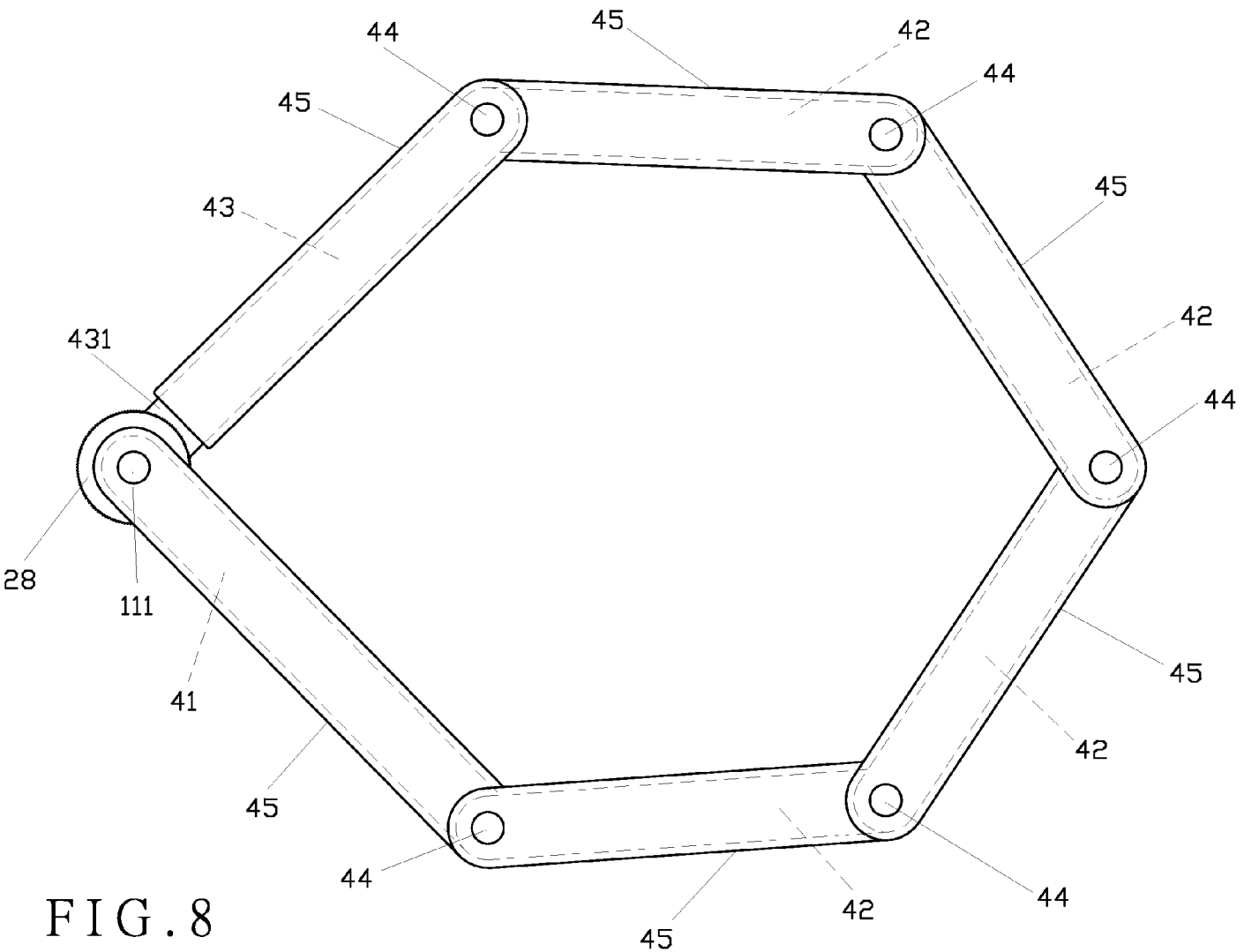
FIG. 8 is a top view of the present invention showing the lock shaft unit in an open status.
Figure 9:
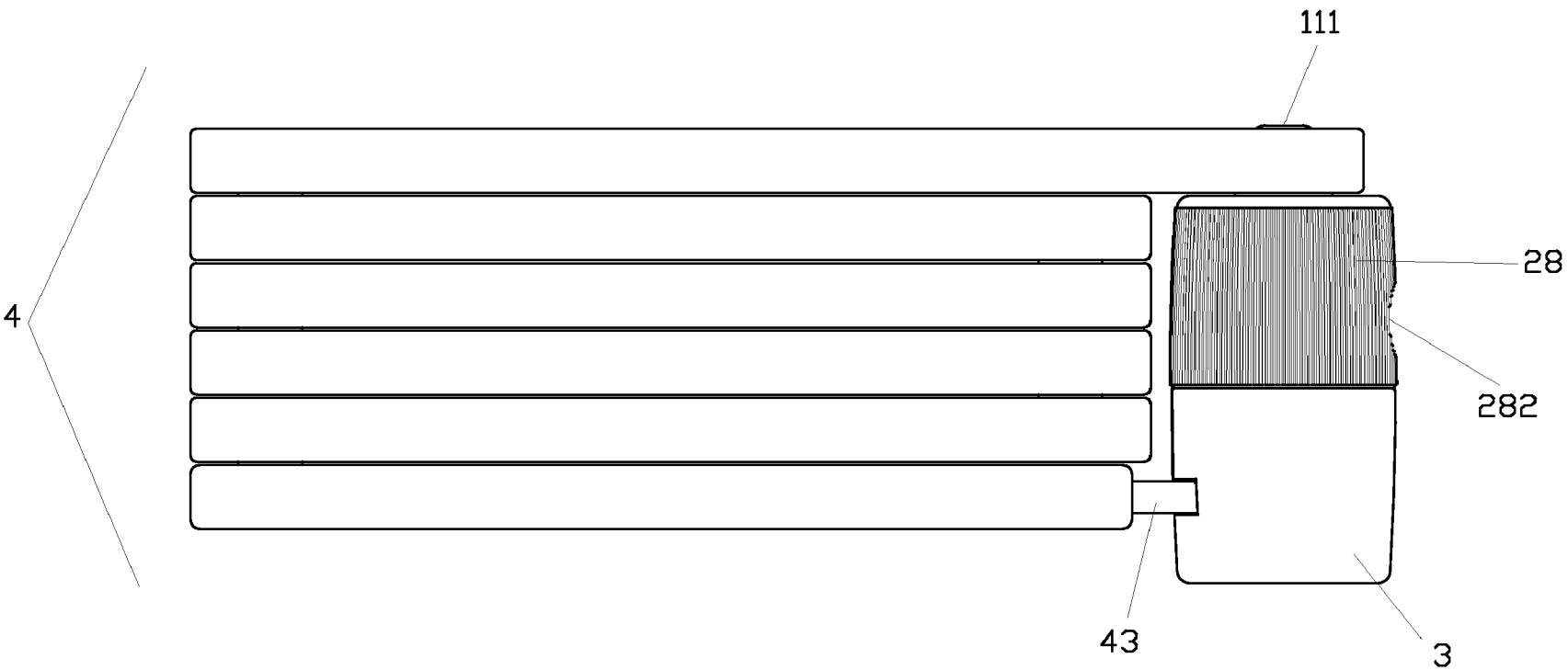
FIG. 9 is a side view of the present invention showing the lock shaft unit in a collapsed status.

The lock shaft unit 4 comprises a connecting rod 41, a linking rod 42, an insertion rod 43 and pins 44. As shown in FIGS. 8 and 9, the lock shaft unit 4 is provided with four linking rods 42 connecting with each other to be a one-piece. As shown in FIG. 1, the linking rod 42 is connected to the connecting rod 41 and the insertion rod 43, respectively. The connecting rod 41 has a pair of connecting ends 411. Each connecting end 411 has a pivot hole 412 thereon. The linking rod 42 has a pair of connecting ends 421. Each connecting end 421 has a pivot hole 422 thereon. The insertion rod 43 has an insertion end 431 and a connecting end 432. The insertion end 431 is in a conical shape with a through hole 433 thereon. The connecting end 432 has a pivot hole 434. When the connecting rod 41, the linking rod 42, the insertion rod 43 and the pins 44 are assembled, the pivot holes 412, 422, and 434 correspond to the pins 44. Each of the connecting rod 41, the linking rod 42, and the insertion rod 43 of the lock shaft unit 4 is wrapped with a plastic layer 45. The connecting rod 41 is pivoted to the lock case 2 and the anti-dust cover 28 by the bolt 111.

To assemble the present invention, as shown in FIGS. 1 and 2, the connecting rod 41, the linking rod 42 and the insertion rod 43 are connected together to form the lock shaft unit 4, and the linking shaft 17, the sliding plate 18, the latch 19 are inserted into the hole 151 and the slot 152 sequentially. By means of the rotation of the linking shaft 17 in the hole 151, the protuberance 172 will slide in the linking slot 181, which links the sliding plate 18 to slide in the groove 15, as well as the latch 19 to slide in the slot 152. The bolt 111 is inserted through the first through hole 11, the second through hole 21, and the through hole 281 of the anti-dust over 28 and engaged with the nut 283, and then extends into the pivot hole 412 of the connecting rod 41.

The lock core 26 is inserted into the first insertion hole 12 and the second insertion hole 22, and a linking block 261 provided on the lock core 26 is inserted into the insertion hole 171 of the linking shaft 17. When the lock core 26 is rotated, the linking shaft 17 will be linked to rotate and the latch 19 will be activated in the first trough 14. The pin 27 is inserted through the first securing hole 13 of the lock head 1 and the second securing hole 23 of the lock case 2 to secure the lock core 26.

The lock head 1 and the lock case 2 are coupled to the cap 3 with the first trough 14 and the second trough 24 corresponding to the fourth trough 32. The other end of the bolt 111 extending through the pivot hole 412 of the connecting rod 41 is riveted flat and connected with the connecting rod 41, the lock case 2 and the anti-dust cover 28 in a rotatable manner. The anti-dust cover 28 is rotatable with respect to the cap 3.

Figure 4:
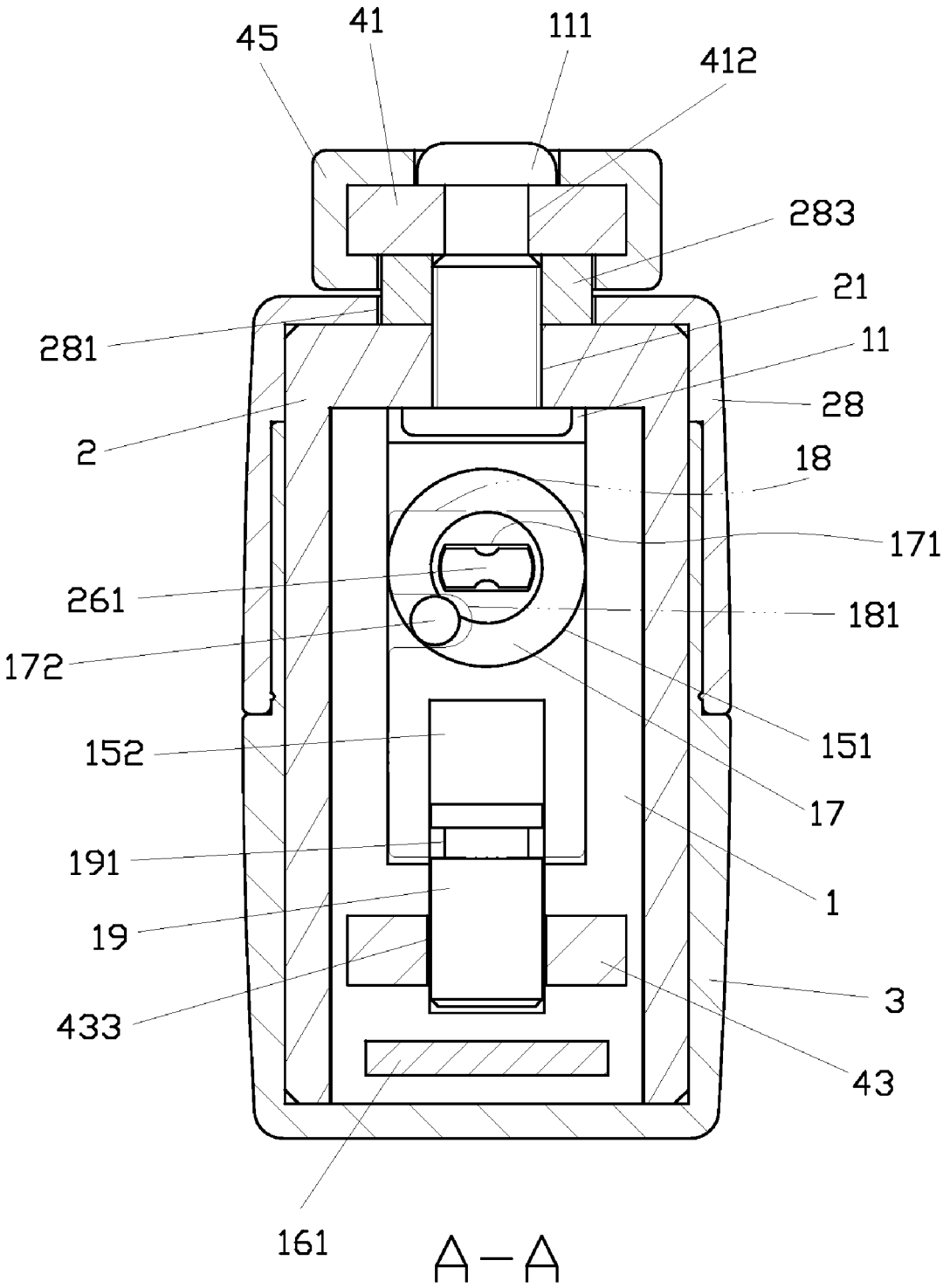
FIG. 4 is a view taken along line A-A of FIG. 3 showing the connection of the latch and the lock shaft unit.
Figure 5:
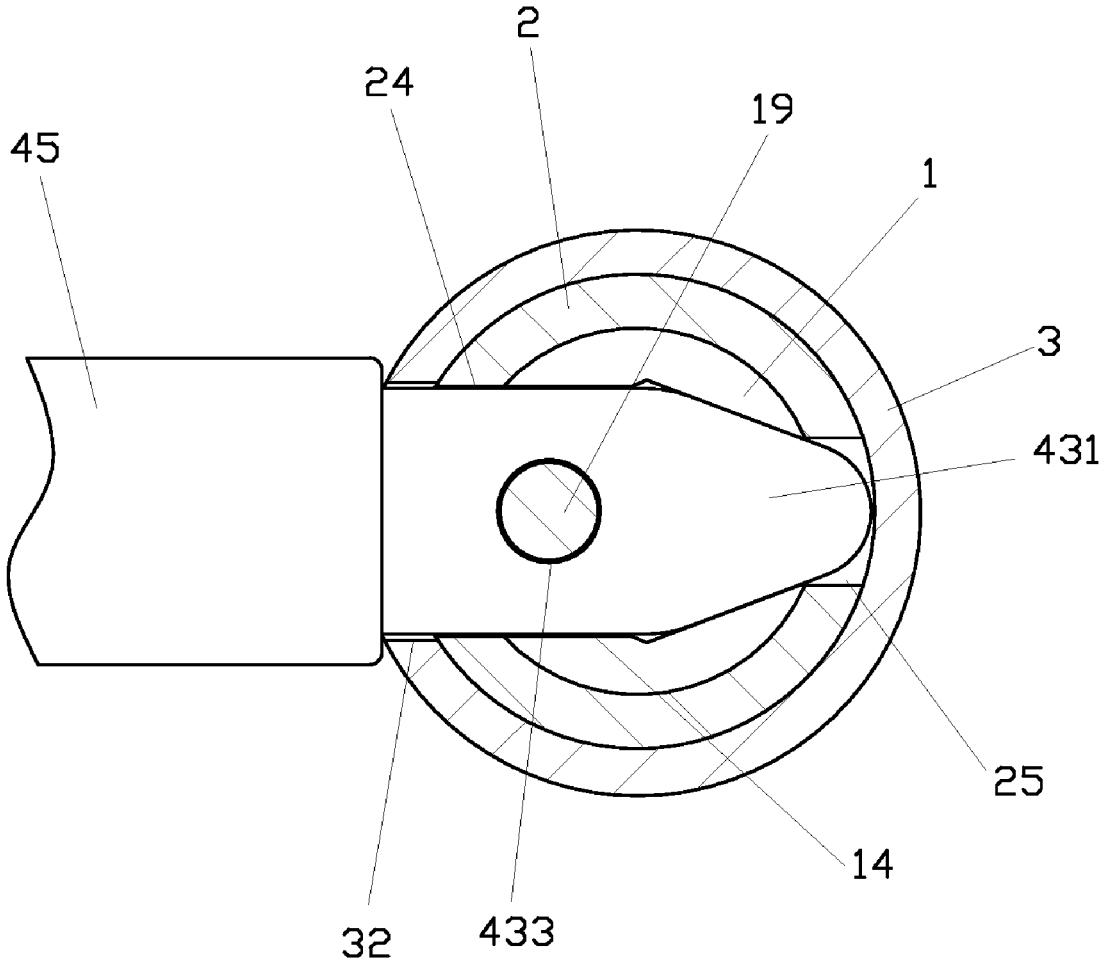
FIG. 5 is a cross-sectional view of the present invention showing that the lock shaft unit is inserted into a second trough and a third trough.

The latch 19 is engaged with the insertion rod 43, as shown in FIGS. 3 and 4. The conical-shaped insertion end 431 of the insertion rod 43 is inserted into the fourth trough 32 of the cap 3, the first trough 14 of the lock head 1, and the second trough 24 of the lock case 2, and engaged with the third trough 25 of the lock case 2. A key C is turned to link the linking block 261 of the lock core 26 to rotate, which links the protuberance 172 of the linking shaft 17 to rotate in the linking slot 181 of the sliding plate 18 to link the linking plate 18 to slide downward in the groove 15; meanwhile, the latch 19 slides outside of the slot 152 and inserts into the through hole 433 of the conical-shaped insertion end 431 of the insertion rod 43. The second trough 24 of the lock case 2 corresponds to the third trough 25, as shown in FIG. 5, and the third trough 25 is smaller in size than the second trough 24, thus the insertion rod 43 is inserted through the second trough 24 and the third trough 25 with the insertion end 431 in contact with the third trough 25. This design provides more contact points. When the insertion rod 43 is inserted into the lock device, the insertion rod 43 will stay steady without looseness because the latch 19 is inserted into the through hole 433 of the insertion end 431 to secure the insertion rod 43. As shown in FIGS. 3 and 4, the anti-dust cover 28 is rotated to keep the third insertion hole 282 of the anti-dust cover 28 not aligned with the lock core 26, preventing foreign objects from entering into the lock core 26.

Figure 6:
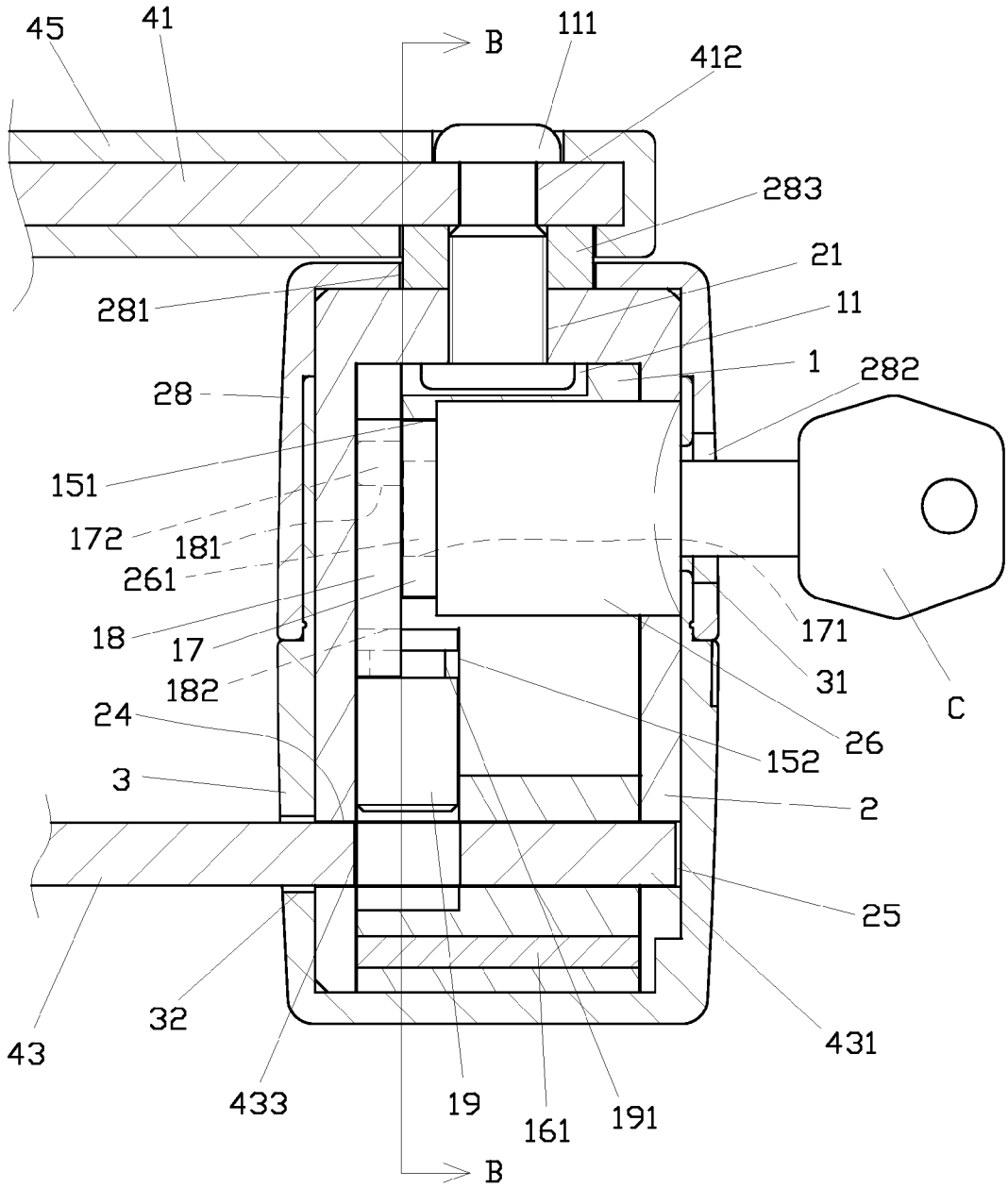
FIG. 6 is a cross-sectional view of the present invention showing that the latch is disengaged from the lock shaft unit.
Figure 7:
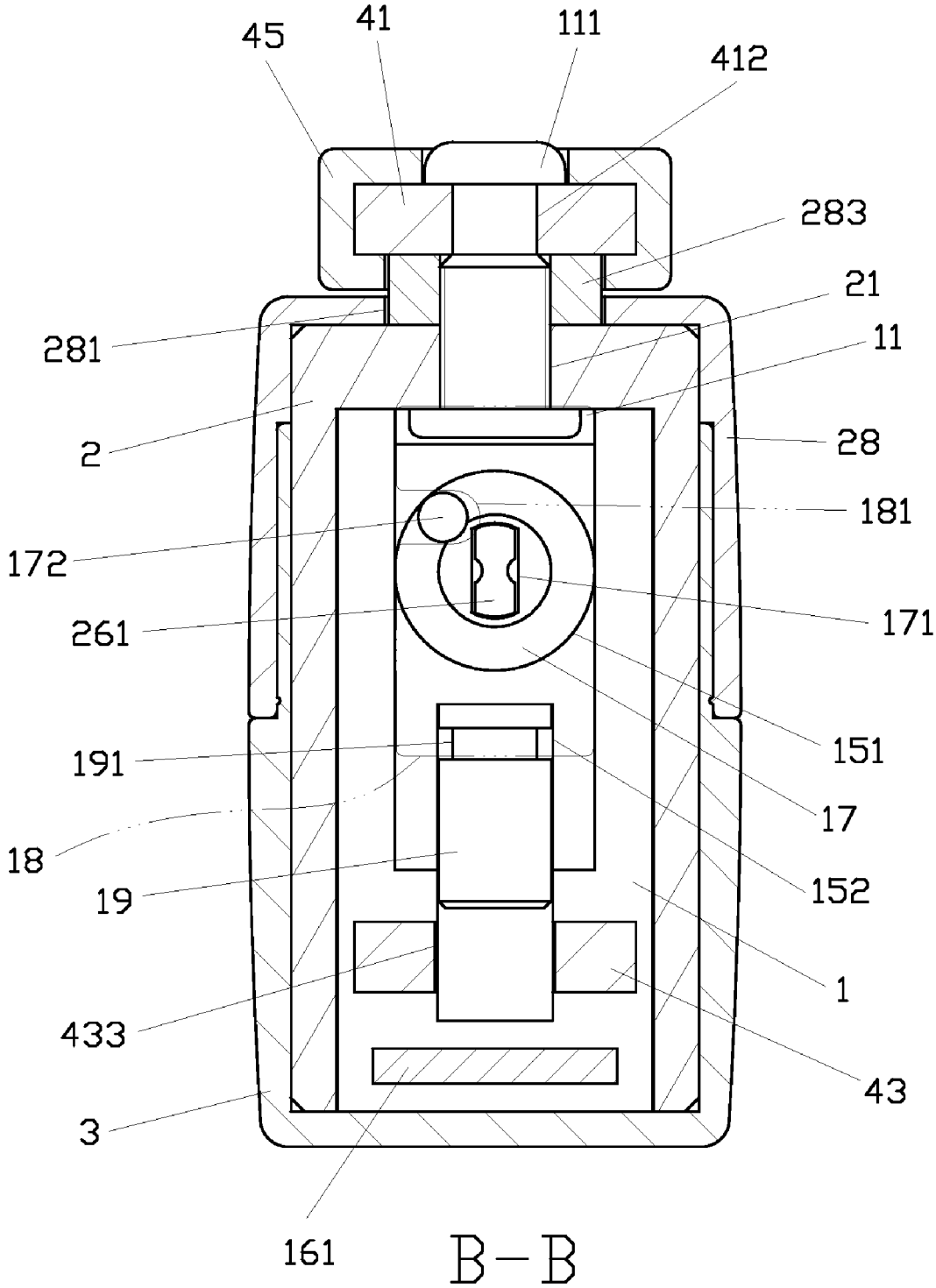
FIG. 7 is a view taken along line B-B of FIG. 6.

To detach the latch 19 from the insertion rod 43, as shown in FIGS. 6 and 7, the anti-dust cover 28 is rotated to align the third insertion hole 282 and the lock core 26. When the key C is turned to activate the linking block 261 of the lock core 26, the protuberance 172 of the linking shaft 17 will rotate in the linking slot 181 of the sliding plate 18 to move the sliding plate 18 upwards along the groove 15; meanwhile, the latch 19 slides in the slot 152 and detaches from the through hole 433 of the conical-shaped insertion end 431 of the insertion rod 43. Referring to FIG. 5, the conical-shaped insertion end 431 of the insertion rod 43 is detached from the second trough 24 and the third trough 25 of the lock case 2, hence the conical-shaped insertion end 431 is detached from the third trough 25 and the second trough 24. The connection of the connecting rod 41, the linking rod 42 and the insertion rod 43 may be changed by their appearances to facilitate the engagement and disengagement.

FIG. 8 shows the present invention in an open status, and FIG. 9 shows the present invention in a collapsed status.

What is claimed is:

1. A lock device comprising a lock head, a lock case, a cap and a lock shaft unit, said lock shaft unit comprising a connecting rod, said lock head being disposed in said lock case, said lock case comprising an anti-dust cover which is connected to and rotatable with respect to said cap, said lock shaft unit being pivotally connected to said lock case, said lock head is provided with a bolt at the top of said lock head to secure a connecting rod of said lock shaft unit with said lock case and said anti-dust cover, allowing said connecting rod to rotate with respect to said lock case and said anti-dust cover.

2. The lock device, as recited in claim 1, wherein said bolt has a cap at one end, a threaded section, and another cap at the other end opposing said cap.

3. A lock device, comprising:

a lock head, said lock head having a first insertion hole and a first trough;

a lock case fitting on said lock head, said lock case comprising a second insertion hole, a second trough and a third trough, said second insertion hole corresponding to said first insertion hole for insertion of a lock core, said second trough corresponding to said first trough, said third trough being opposite to said second trough, said lock case further comprising an anti-dust cover having a third insertion hole;

a cap disposed on said lock case, said cap being rotatable with respect to said lock case, said anti-dust cover being rotatable with respect to said cap, said cap having a fourth insertion hole and a fourth trough, said fourth insertion hole corresponding to said first insertion hole and said second insertion hole, said fourth trough corresponding to said first trough and said trough;

a lock shaft unit pivoted to said lock shaft unit comprising a connecting rod, a linking rod, and an insertion rod, both said connecting rod and said linking rod having a pair of pivot holes at respective ends thereof, said insertion rod having an insertion end and a connecting end, said insertion end being in a conical shape with a through hole thereat, said connecting end having a pivot hole for insertion of a pin, said connecting rod being pivoted to said lock case, said insertion end corresponding to and inserting into said fourth trough, said first trough, said second trough and said third trough.

4. The lock device, as recited in claim 3, wherein said lock head is provided with a bolt at the top of said lock head to secure said connecting rod of said lock shaft unit with said lock case and said anti-dust cover, allowing said connecting rod to rotate with respect to said lock case and said anti-dust cover.

5. The lock device, as recited in claim 4, wherein said bolt has a cap at one end, a threaded section, and another cap at the other end opposing said cap.

6. A lock device, comprising:

a lock head, said lock head comprising a first through hole, a first insertion hole, a first securing hole, a first trough, a groove and a tray, a hole and a slot being formed in said groove for insertion of a linking shaft, a sliding plate and a latch, said linking shaft corresponding to said hole and having an insertion hole and a protuberance, said sliding plate having a linking slot and a connecting trough, said linking slot being adapted to receive said protuberance, said latch having a circular trough to engage with said connecting trough, said latch corresponding to said first trough, a plate being provided in said tray, said first through hole being provided with a bolt;

a lock case fitting on said lock head, said lock case having a second through hole, a second insertion hole, a second securing hole, a second trough, and a third trough, said second through hole corresponding to said first through hole, said second insertion hole corresponding to said first insertion hole, said second securing hole corresponding to said first securing hole, said second trough corresponding to said first trough, said second trough being in parallel with said third trough, said lock case further comprising an anti-dust cover having a through hole and a third insertion hole, a nut being provided in said through hole;

a cap disposed on said lock case, said cap having a fourth insertion hole and a fourth trough, said fourth insertion hole coffesponding to said first insertion hole and said second insertion hole, said fourth trough corresponding to said first trough and said second trough; and a lock shaft unit, said lock shaft unit comprising a connecting rod, a linking rod, and an insertion rod, both said connecting rod and said linking rod having a pair of pivot holes at respective ends thereof, said insertion rod comprising an insertion end and a connecting end, said insertion end being in a conical shape with a through hole thereat, said connecting end having a pivot hole, a number of pins being inserted into said pivot holes, said connecting rod being connected to said lock case and said anti-dust cover through said bolt of said lock head, and secured to said lock case with said nut.

7. The lock device, as recited in claim 6, wherein said bolt has a cap at one end, a threaded section, and another cap at the other end opposing said cap.

8. The lock device, as recited in claim 7, wherein said bolt is inserted through said first through hole, said second through hole, and said through hole of said anti-dust cover, and secured with said nut with a portion extending into a pivot hole of said connecting rod.

* * * * *